United States Patent [19]

Valenti et al.

[11] Patent Number: 4,493,482

[45] Date of Patent: Jan. 15, 1985

[54] MOTION STABILIZING AND ALIGNING APPARATUS FOR MOVING FOLDED SIGNATURES THROUGH AN INK JET PRINTER

[75] Inventors: Edward R. Valenti, Oak Park; Thomas J. Adamczyk, Mount Prospect; Larry W. Graham, Schaumburg, all of Ill.

[73] Assignee: Alden Press, Inc., Elk Grove Village, Ill.

[21] Appl. No.: 536,289

[22] Filed: Sep. 27, 1983

[51] Int. Cl.[3] ..... B65H 39/02

[52] U.S. Cl. ..... 270/12; 400/126; 270/58

[58] Field of Search ..... 270/12, 1.1, 15, 54, 270/58; 400/126

[56] References Cited

U.S. PATENT DOCUMENTS

| | | | |
|---|---|---|---|
| 3,819,173 | 6/1974 | Anderson et al. | 270/54 |
| 4,027,142 | 5/1977 | Paup et al. | 270/1.1 X |
| 4,121,818 | 10/1978 | Riley et al. | 270/58 X |

*Primary Examiner*—E. H. Eickholt

*Attorney, Agent, or Firm*—Russell E. Hattis

[57] ABSTRACT

In a booklet-making system including a collating conveyor having an inverted V-shaped top profile for receiving folded signatures to be draped thereover, a signature raising plate is provided in the path of movement of the signature to and past an ink jet printing station for raising preferably only one side or panel of the conveyor draped signature to be printed upon and the fold thereof above the conveyor so that the signature is not then supported by the conveyor. Signature backing and aligning apparatus is provided opposite the printing station for receiving the fold of the raised signature or stack of signatures and for acting as a backing support therefor to stabilize and align the same as it moves past said printing station. In one form of the invention this apparatus includes the longitudinal edge of the signature raising plate which engages and forces the raised fold toward a backing wall. In the other form of the invention this apparatus includes an angle bar whose vertical leg forms said vertical backing wall and air jet nozzles for directing jets of air against the crotch of the fold of the raised signature to push the fold edge thereof into the crotch of the angle bar.

16 Claims, 13 Drawing Figures

MOTION STABILIZING AND ALIGNING APPARATUS FOR MOVING FOLDED SIGNATURES THROUGH AN INK JET PRINTER

TECHNICAL FIELD OF INVENTION

This invention relates to the printing of customized information on the outer face of a folded sheet of paper or the like, referred to as a signature, conveyed by a collating conveyor chain upon which similar signatures are stacked prior to their being bound together to form a booklet. More specifically, this invention relates to signature motion stabilizing and aligning apparatus which constrains the signature for movement over a predetermined path while an ink jet printer directs a controlled pattern of ink upon the outer face of the signature.

BACKGROUND OF INVENTION

Booklets, like mail order advertising brochures, are typically mass-produced in printing plants by apparatus which includes a signature collating conveyor chain formed by interconnected inverted V-shaped chain links over which sharply folded sheets or signatures are sequentially draped in stacked relation to form booklet bodies. The conveyor chain moves over a path passing by spaced signature feeding stations which include signature feeding means for successively draping and stacking the sharply folded pre-printed signatures over the conveyor chain, with the crotch of each signature fold resting on or overlying the apices of the chain links. Some of the chain links include horizontally projecting lugs (to be referred to as signature positioning and pushing means) which engage the trailing edges of the various stacks of signatures draped over the chain, to position and align the same. The conveyor moves the completed stacks of signatures on the conveyor chain to a stitching or binding station which commonly applies binding staples through the folds of the stack of signatures to form bound booklets. The bound booklets are then commonly delivered to a trimming station and then to a labeling station where mailing labels are applied which are pre-printed or printed on line with the desired addressee information.

When the booklets involved are advertising booklets which desirably contain order forms on the inside thereof, it is desirable to incorporate on the order forms in the booklets the name and address of the addressee thereof so that the person ordering the merchandise involved does not have to bother printing his name and address on the order form. Thus, U.S. Pat. No. 3,819,173 to Anderson et al, granted June 25, 1974 discloses computer controlled booklet-making apparatus which includes a printing station which prints addressee information on a pre-printed order form card which is then inserted within each stack of signatures on the conveyor chain prior to its application to the binding and labeling stations.

The desirability of using an ink jet printing head for printing mail order form addressee information directly on a moving sheet of paper or the like having a to-be-printed or pre-printed order form thereon and other printing to form a mail order advertising booklet is disclosed in U.S. Pat. No. 3,911,818 to MacIlvaine, granted Oct. 14, 1974. The ink jet printing head referred to in this patent provides ink jet nozzles from which ink can be selectively directed upon a printing surface in a direction transverse to the direction of movement of the sheet of paper involved. By controlling the position of the ink jets issuing from these nozzles at any instant of time and the timing of the position changes thereof in relation to the speed of movement of the sheet of paper the desired letters and numbers are formed to produce the desired addressee information upon the spaces on the order form provided therefor. While the MacIlvaine patent discloses the sheet of paper as a single moving web of paper, it is manifest that the moving web can be replaced by any moving sheet of paper, like a signature draped over a conveyor chain which advances the signature to the various stations in a booklet-making line. The present invention applies to such a printing operation.

Various types of ink jet printers are presently being used to print addressee information on a moving conveyor chain carried signature forming part of a mail order advertising booklet. Thus, one type of known printing head manufactured by the Mead Corporation of Dayton, Ohio uses a separate vertically oriented ink jet nozzle for each segment of the numbers and letters involved. The separate nozzles are very small and are aligned in closely spaced relationship along a line transverse to the direction of movement of the conveyor chain. The pattern of ink issuing from the nozzles at any instant is varied in synchronism with the chain speed to form the desired imprint.

The aforementioned McIlvaine patent and U.S. Pat. No. 4,121,818 to Riley et al, granted Oct. 4, 1978, disclose the previously described form of ink jet printing head including one or more nozzles oriented to direct what is disclosed in the drawings of these patents as a deflectable, generally horizontally extending ink jet on a generally vertically extending face of a web of paper or conveyor chain carried signature. In such case, a single ink jet can form the various vertical segments of any letter or number by controlling its deflected ink ejecting position.

In either case, to obtain the best printing results, it is important to stabilize and align the movement of the web or signature past the ink jet printing head involved, so that the information printed thereon will be properly aligned on the order forms (and labels where the labels are similarly printed "on-the-fly"). Various means have been heretofore utilized for stabilizing the motion of the signature as it is moved past the ink jet printing heads. While these means have generally provided acceptable results, they have left much to be desired. Thus, longitudinally spaced pressure rollers have been proposed to press the upstanding folds at the juncture of vertically extending signature panels against the apices of the chain links. Pressing the folded signatures during a printing operation against the apices of the conveyor chain links is unsatisfactory if the apices of the conveyor chain links do not remain perfectly aligned in longitudinal and lateral directions. Generally, the apices of the chain links do not have a sufficiently consistent elevation and lateral position that one would want to use the upper surface as a guide for the path of movement of the signatures during a printing operation.

Where the printing head is to direct the ink jets in a generally vertical direction upon a signature surface, the signature panels draped over the conveyor chain must be raised to a horizontal position as is required when using the Mead printing unit previously described. We have carried out experiments with various means for stabilizing the position of the raised panels of such a signature by longitudinally spaced rollers and other pressure applying means pressing down on the raised signature panels supported on a horizontal table while the still vertically oriented fold thereof remains on the conveyor chain. It was found that, frequently, horizontal or lateral shifting of the signatures took place as the leading edges of the signatures first passed under the first pressure roller or other pressure applying means. This lateral shifting of the signatures caused the printing to be mis-aligned with the order form spaces provided therefor.

It is the object of the present invention to improve the quality of the printing achieved by use of ink jet printing heads printing on moving conveyor chain-supported signatures by providing the best possible alignment of the printing on the signatures.

SUMMARY OF THE INVENTION

In accordance with the present invention, we recognized the fact that stabilizing the motion of the moving conveyor chain carried signature or stack of signatures to be printed upon past an ink jet printing head can be best achieved if the signature involved is completely removed from contact with the apices of the collating conveyor chain links, so that the signatures are not supported upon the chain (or other similar conveyor means) during the printing operation. It is thus one of the features of the present invention to provide a signature raising means in the path of movement of the signatures immediately upstream of the ink jet printing heads, which means raises the fold of the signature or stack of signatures to be printed upon from the apices of the collating conveyor chain links. Preferably, the signature raising means raises only one side of the folded signature to be printed upon and the fold of the signature, so that the still vertically extending trailing edge of the other half of the signature involved can be engaged and pushed by the previously mentioned horizontally projecting lug or the like moving at the speed of the collating conveyor.

The signature or stack of signatures raised from the conveyor chain is backed and aligned by what is referred to sometimes as a backing and aligning means. In one form of the invention, this backing and aligning means comprises at least an angle bar or the like forming on the inside thereof an aligning crotch against which the edge of the fold of the signature or stack of signatures involved is forced by air jets directed against the inside of the signature fold. In another form of the invention, the signature fold is aligned by the longitudinal edge of a support plate constituting part of said signature raising means, where only one side of the signature or stack of signatures is raised. In such case, this edge extends above and beyond the apices of the conveyor chain links where the fold, pushed by this edge from the chain apices thereof, closely extends around this edge, which thus aligns the signature or stack of signatures involved in the direction of conveyor movement.

In both of these forms of the invention, where only one side of the signature or stack of signatures is raised the still vertically extending side thereof is backed by a backing wall which may be the vertical leg of the angle bar referred to. It is preferred that the signature stabilizing and aligning means of the invention be operable in both ways just described, because the most reliable method for signature motion stabilization and alignment depends on the size and thickness of the signatures involved.

In accordance with a specific aspect of the invention, where the signature panel to be printed upon is raised to a generally horizontal position, the signature raising means is most advantageously a gull wing plate, which has progressively upwardly and downwardly inclining upstream and downstream ends and a raised horizontal intermediate portion forming the support table for the raised signature panel. The position of this plate is laterally horizontally adjustable so that its longitudinal edge can underlap in selected degrees the horizontal leg of the angle bar described above, and is vertically adjustable to vary its spacing below this leg, so that the raised portion of the signature or stack of signatures involved is loosely confined between the horizontal leg of the angle member and the horizontal portion of the gull wing plate. Where the signature fold is forced by air jets against the crotch of the angle bar, the longitudinal edge of the support table portion of the gull wing plate is retracted to leave clearance for the air jets.

The just described and other features and advantages of the invention, will become apparent upon making reference to the specification to follow and the claims and drawings.

DESCRIPTION OF EXEMPLARY EMBODIMENT OF THE INVENTION SHOWN IN DRAWINGS

Figure 1:
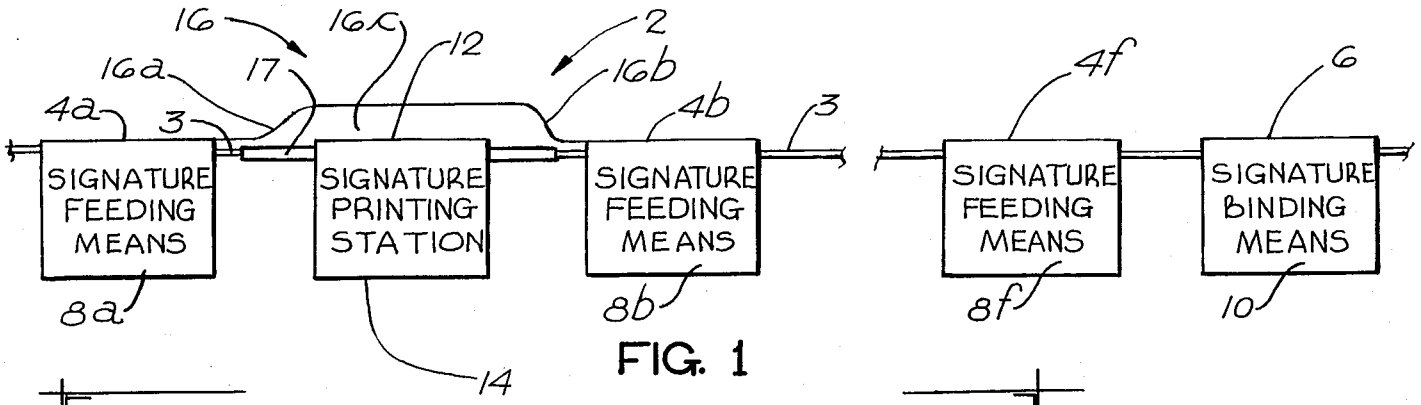
FIG. 1 is a block diagram illustrating a portion of a typical booklet-making machine production line including an ink jet signature printing station at which the signature motion stabilizing means of the present invention is located.

Referring now to FIG. 1, there is there shown a block diagram of a portion of a typical booklet-making system modified by the incorporation of the present invention. The system, generally indicated by reference numeral 2, includes a conveyor formed by an endless conveyor chain 3 driven in any well-known suitable way by a drive motor 5 (shown in block form in FIG. 10). The conveyor chain is formed by interconnected, inverted V-shaped links 3*a* best shown in FIGS. 3A and 3B, each of which links has a rounded apex 3*a*-2 and downwardly and outwardly inclining longitudinal side walls 3*a*-1 and 3*a*-3. Some of the links 3*a* have horizontally projecting lugs 3*b* which act as signature position and pushing means. These lugs are spaced apart a distance somewhat greater than the desired distance of the various individual signatures or stacks of signatures 7 deposited on the conveyor chain. The lugs 3*b* engage the trailing edges of these signatures or stacks of signatures to act as positioning means therefor.

The upper section of the endless conveyor chain 3 moving in a direction to the right as viewed in FIG. 1 is shown passing by a signature feeding station 4*a* having well known signature feeding means 8*a* which sequentially drapes over the chain 3 pre-printed signatures each forming one of the sections of the booklet involved. It is conventional that such signatures have a very sharp crease or fold at the middle point thereof identified by reference numeral 7*a* in FIGS. 3A and 3B. When the signatures are delivered to the conveyor, the crotch 7*a*' of this fold is centered over the apices 3*a*-2 of the underlying chain links 3*a*. The leaves or panels of the folded signature then extend downwardly along the inclined surfaces 3*a*-1 and 3*a*-3 of the chain links until acted on by the apparatus of the present invention.

As previously indicated, one application of the present invention is in the making of mail order advertising booklets and the like, which often desirably have preprinted order forms on the inside thereof frequently but not necessarily located near the center portion or in the center of the booklet. Where this mail order form is to incorporate in the booklet as mailed the name and address of the addressee of the booklet, this information is desirably printed on this order form "on-the-fly" as the signature is moving past a printing station 12 including a printing unit 14 having a computer-controlled ink jet printing head portion 14*a* shown in FIGS. 2 and 8 capable of directing a desired pattern of tiny ink jet dots or streams in the desired portion of the order form where the addressee information is to be located. This mail order form printing operation could theoretically take place after the last signature feeding station, but the most logical place to do so is after the first or second signature feeding station where the signature raising means to be described need only lift one or a few signatures to expose the order form. In the former case, the order form-containing signature must be exposed by temporarily removing or lifting the signatures above the one to be printed upon, to expose the order form-containing signature on the inside of the booklet involved.

Figures 3A, 3B, 4, 5, 6, 7A, 7B, 8:
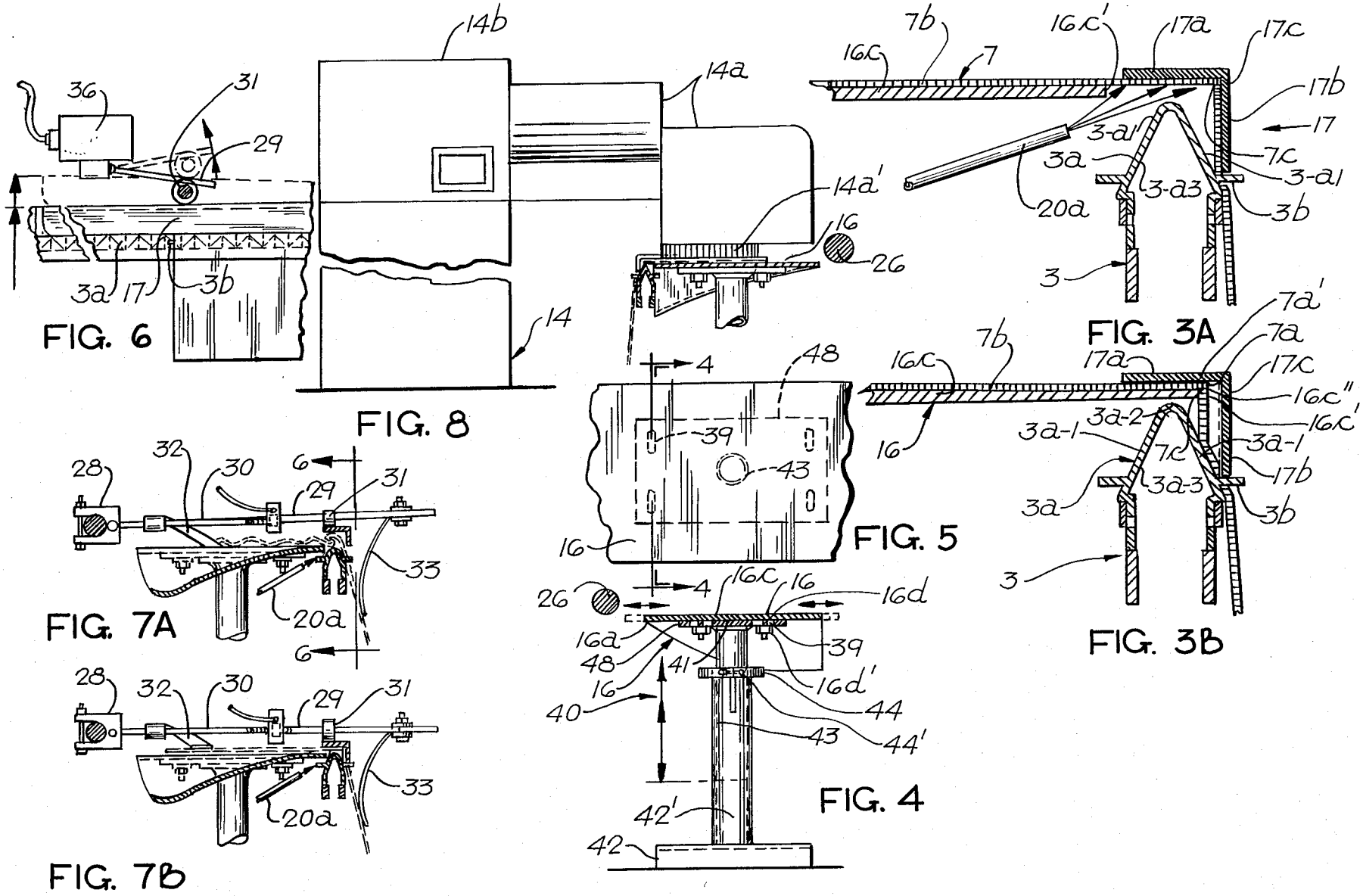
FIG. 3A is an enlarged fragmentary vertical sectional view through the apparatus shown in FIG. 2, taken along section line 3A—3A therein, and shows the manner in which a partially raised signature is forced against the crotch of a signature backing and aligning angle member by a stream of air, so that the edge of the fold of the signature remains aligned against the crotch of the angle bar.
FIG. 3B is a view corresponding to FIG. 3A, where the air stream assist is not be utilized to keep the edge of the fold against the crotch of the signature backing and aligning means.
FIG. 4 is a vertical sectional view through one of the support structures for the gull winged plate which raises the signature from the conveyor chain, the figure showing the manner in which the position of the gull wing plate is both vertically and laterally adjustable, FIG. 4 being a sectional view taken along section line 4—4 in FIG. 5.
FIG. 5 is a fragmentary plan view of the gull wing plate showing in dashed lines the support structure therebelow shown in FIG. 4.
FIG. 6 is an enlarged, fragmentary, vertical sectional view through the apparatus shown in FIG. 2, taken along section line 6—6 therein, and illustrating the anti-jamming apparatus which responds to an upward force on the signature backing and aligning means indicating a signature jamming condition to stop the operation of the chain conveyor.
FIG. 7A is a fragmentary sectional view of the apparatus shown in FIG. 2, taken along section line 7A—7A where there has been a jam-up of the signature requiring stopping of the conveyor, the figure showing such jam-up causing an upward force and the resulting pivoting of the structure there shown, as also shown in dashed lines in FIG. 6.
FIG. 7B is a figure corresponding to FIG. 7A under the circumstances where the equipment is operating properly.
FIG. 8 is a fragmentary transverse sectional view of the apparatus of FIG. 2, taken along section line 7—7, showing the ink jet printing head in position contiguous to the raised side of a signature to print addressee information thereon.

The ink jet printing head portion 14*a* is most desirably of the type which directs a pattern of ink dots downwardly in a vertical direction, such as the ink jet printing unit commercially sold by the Mead Corporation. FIG. 8 shows the signature printing station 12 containing such a signal printing unit, with the printing head portion 14*a* overlying a portion of the conveyor chain 3. The printing head portion 14*a* of the unit 14 is adjustable in both horizontal and vertical directions, so that the ink jet nozzles thereof are properly positioned just above the plane of horizontally oriented signature panel 7*b* (FIG. 3A) of the signature 7 and opposite the order form thereof.

The conveyor chain 3 illustrated in FIG. 1 moves by numerous other signature feeding stations like stations 4*b* and 4*f* following the printing station 12, which have signature feeding means like means 8*b* and 8*f*, which drape additional signatures upon previously applied signatures to build up a booklet having the desired printed material in a completed booklet. When the conveyor chain 3 leaves the last signature feeding station 8*f* there will be deposited thereon at longitudinally spaced points along the conveyor chain 3, as determined by the spacing of the signature positioning lugs 3*b*, unbound stacks of booklet-forming signatures. These signatures are then sequentially fed by the conveyor past a binding station 6 having suitable booklet binding means 10 for applying binding staples or the like through the folds of the stacks of signatures involved. Although not shown in FIG. 1, these bound signatures are then generally delivered to another conveyor which carries the bound signatures to other stations which perform trimming and labeling operations. The labeling operation can be an "on-the-fly" mailing label printing operation like the order form printing operation.

As previously indicated, the present invention deals with improved signature motion stabilizing means which stabilize and maintain the desired path of movement of the signatures to be printed upon as they are moved by conveyor chain 3 along a horizontal path past the printing head portion 14*a* of the printing unit 14.

In accordance with the preferred form of the invention, there is provided signature raising means which raises only one side portion of each folded signature or stack of signatures to be printed upon and the fold thereof from the apices of the conveyor chain link 3*a*. The signature raising means is most preferably described as a gull wing plate 16 which has a gradually rising leading end portion 16*a* upstream from the signature printing station 12 and a gradually declining end portions 16*b* downstream from the signature printing station 12. The rising leading end portion 16*a* progressively raises one of the panels of each signature to a point above the level of the top of the conveyor chain 3. The intermediate portion 16c of the plate opposite the printing head portion 14a of the printing unit 14 forms a horizontal support table portion positioned above the top of the chain links 3a. As will appear, a longitudinal edge 16c' of the support table portion of the plate (FIG. 2) forms part of the signature stabilizing and aligning means in one form of the invention. This means, as illustrated, also includes an angle bar 17 having a horizontally extending leg 17a and a depending leg 17b (FIGS. 3A and 3B) defining therebetween a sharp signature backing and aligning crotch 17c aligned perfectly in a horizontal plane and parallel to the direction of motion of the conveyor chain 3.

The longitudinal edge 16c' of the gull wing plate 16 confronts the underside of the angle bar 17. In a manner to be described, the plate 16 is horizontally and vertically adjustable toward and away from the angle bar 17 to adjust the spacing therebetween. The vertical spacing between the plate 16 and the inner surface of the horizontal leg 17a of the angle bar is made so that the one or more panels of the signatures which are raised into a horizontal position by the plate 16 are loosely received therebetween. As the side of the signature or signatures involved is raised by the gull wing plate 16, the fold thereof, which was initially centered on the apices of the inverted V-shaped chain links 3, is shifted upwards and laterally toward the angle bar 17. In the form of the invention shown in FIG. 3B, this is achieved by the longitudinal edge 16c' of the gull wing plate, which is adjusted to a position where the longitudinal edge 16c' extends over and beyond the apices of the chain links 3a contiguous to the vertical leg 17b of the angle bar 17. This edge 16c' is formed by an outwardly bulging portion of the table portion 16c of the gull wing plate opposite the printing station 12, as best shown in the broken-away plan view of FIG. 2. This edge 16c' pushes horizontally against the crotch 7a' of the signature fold to shift it laterally away from the conveyor chain toward the vertical leg of the angle bar, and in so doing causes the signature fold to closely follow the contour of the edge 10c' to align the signature. The longitudinal edge 16c' of the plate preferably has a finite thickness forming a rectangular outline as seen in FIG. 3B, so as to form a sharp corner 16c'' which is aligned with the fold 7a'. The bottom portion of the vertical leg 17b of the angle bar 17 applies a backing force against the still downwardly extending side of the signature or stack of signatures involved sliding thereagainst, so that the signature or stack of signatures are confined and their path of movement stabilized between the plate edge 16c' and the vertical leg 17b of the angle bar.

In the other mode of operation of the invention illustrated in FIG. 3A, the gull wing plate 16 is retracted to a point on the side of the conveyor chain remote from the angle bar 17, so that the longitudinal edge 16c' thereof serves only to assist in the aligning function primarily performed by the crotch 17c of the angle bar 17. Here, the alignment operation is assisted by air jets 20a and 20a' (see FIG. 9) which, because of the retraction of the gull wing plate, can direct their jets of air in the space then provided between the conveyor chain links 3a and the longitudinal edge 16c' of the gull wing plate. This air is directed against the bottom surface of the signature or stack of signatures involved, to force the same to the right where the edge of the fold 7a thereof is forced into the aligning crotch 17c of the angle bar 17.

There may be occasions where the signatures will become jammed between the gull wing plate 16 and the angle bar 17, as illustrated in FIG. 7A. In such case, the signature becomes creased and folded to apply an upward force on the angle bar 17. To this end, means now to be described are provided which, upon the presence of such a signature jamming force, results in the de-energization of the conveyor motor 5. Thus, the opposite ends of angle bar 17 are secured as by welding to annular collars 31—31' through which extend pivot rods 29—29'. The collars 31—31' are slidable along the rods 29—29' and lockable in an adjusted position thereon by locking screws 31a—31a'. The rods 29—29' pass into slots in pivot brackets 27—27' which are pivotable about and secured to the stationary support rod 26. The pivot brackets 27—27' are bifurcated so as to leave space for adjustable shoulder-forming collars 39—39'. The collars 39—39' are lockable in any adjusted rotational position on the rod 26 by locking screws 39a—39a'. Projecting radially from the collars 39—39' are shoulder-forming projections 39b-39b' upon which portion of the pivot brackets 27—27' come to rest at a given desired lowered position of the angle bar 17.

There are provided control switch support brackets 28—28' secured to the support rod 26. Extending from support brackets 28—28' are arms 30—30' carrying switch units 36—36' on the ends thereof. The switch units 36—36' have downwardly spring urged actuating arms 38—38' which bear down upon the angle bar carrying rods 29—29' to urge the same into a downward position against the shoulder-forming projections 39b—39b'. It is thus seen that when there is a jam up of the signature of sufficient magnitude to create a substantial upward force against the angle bar 17, the angle bar can pivot upwardly against the downward spring force of the switch actuating arms 38—38' to open a normally-closed switch 36a (FIG. 10) in series with the main power on-off switch contactor 39 leading to the AC power supply which supplies power to the conveyor motor 5.

Figures 9, 10, 11:
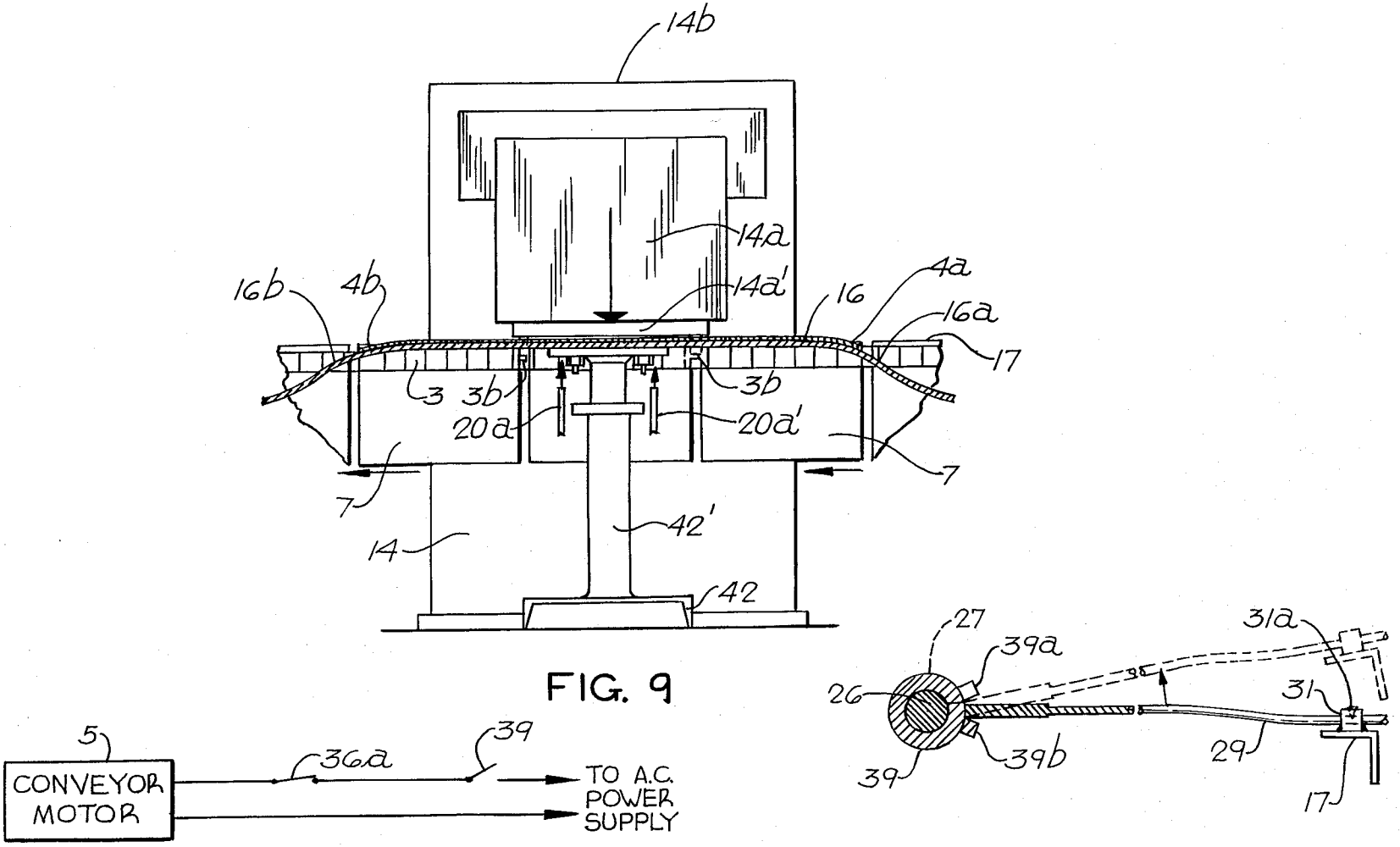
FIG. 9 is a longitudinal vertical sectional view through the apparatus shown in FIG. 2, taken along section line 9—9 therein.
FIG. 10 is simplified diagram showing the manner in which power to the chain conveyor motor is controlled through an on-off switch and a switch controlled by the anti-jamming apparatus previously described.
FIG. 11 is a transverse vertical sectional view of the apparatus of FIG. 2, taken along section lines 11—11 thereof to show the angle bar elevation adjusting means.

The manner in which the elevation and lateral position of the gull wing plate 16 is adjusted is best shown by reference to FIGS. 4 and 9, to which reference is now made. The gull wing plate 16 illustrated in the drawings has opposite the printing station 12 four depending bolts 16d which respectively pass through laterally elongated apertures 39 in a head plate 41 of a support structure 40 for the gull wing plate. The gull wing plate 16 is thusly laterally adjustable upon the head plate 41 and is shown held in a lateral position by nuts 16d'. The head plate 41 is supported on a vertical post 43 fitting into the internal bore of a split hollow post 42' projecting upwardly from a base member 42 supported on the floor. A clamping collar 44 or the like surrounds the split upper end of the post 42 and is tightly secured therearound by clamping screws 44' which lock the post 43 in its vertically adjusted position within the hollow post 42'.

Figure 2:
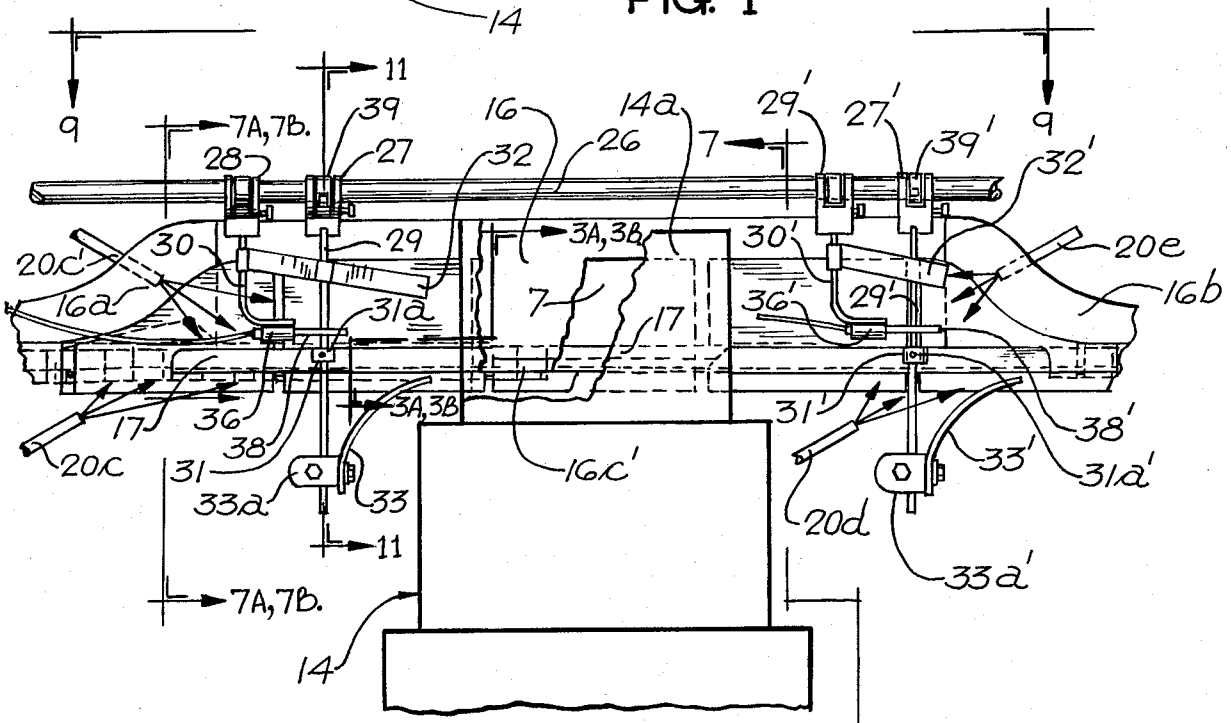
FIG. 2 is a plan, broken-away view of an actual signature printing station diagrammatically illustrated in FIG. 1, together with the associated signature motion stabilizing means of the invention in the most preferred form thereof.

FIG. 2 shows other elements of the signature motion stabilizing apparatus of the invention to insure optimum operation thereof. Thus, rods 30—30' carry leaf springs 32—32' which normally bear upon the raised portions of the signatures respectively just beyond and ahead of the upwardly inclining upstream end and the declining downstream ends of the gull wing plate 16. Also, for stabilizing purposes, the support rods 29—29' carry spring arms 33—33' which bear against the sides of the continuous vertically depending sides of the signatures, to urge the same inwardly against the sides of the conveyor chain 3. Various air jet nozzles 20*c*–20*c'*, 20*d* and 20*e* also direct streams of air against the top and sides of the signatures to maintain the signatures in a stabilized position as they are being raised and lowered at the upstream and downstream ends of the gull wing plate 16.

It should be apparent that the present invention provides an exceedingly simple and effective means for stabilizing the path of movement of the signatures as they are moved passed the signature printing station 12.

It should be understood that numerous modifications may be made in the most preferred forms of the invention described without deviating from the broader aspects of the invention.

We claim:

1. In a booklet-making system including a collating conveyor means having an inverted V-shaped top profile for receiving folded signatures to be draped thereover, said conveyor extending over a given path passing by spaced signature feeding stations having signature feeding means for sequentially draping and stacking folded signatures over longitudinally spaced points of the conveyor means, with the crotch of the fold of each signature resting on the apex of the conveyor means so as to form booklet-forming signature stacks having panels on opposite sides of their folds extending generally vertically downwardly therefrom, said conveyor means having horizontally projecting signature stack positioning and pushing means for engaging the trailing edges of the signature stacks draped on the conveyor means for positioning and aligning the same therealong, and a printing station where an ink jet printing means is to be located by said conveyor means following one of said signature feeding stations for projecting ink jets in selectively controlled patterns in synchronized relation with the speed of movement of the conveyor means to print customized information on the exposed face of a signature draped on said conveyor means, the improvement wherein there is provided signature raising means in the path of movement of the signature or stack of signatures to and past said printing station for raising the draped signature or stack of signatures involved to be printed upon and the fold thereof above the conveyor means involved, so that the signature or stack of signatures are not then supported by the conveyor means, and signature backing and aligning means opposite said printing station for receiving the fold of the raised signature or stack of signatures, and for acting as a backing support therefor to stabilize and align the same as it moves past said printing station.

2. The booklet-making system of claim 1 wherein said signature backing and aligning means includes a crotch-forming means into the crotch of which the fold of said signature or stack of signatures is forced when raised by said raising means.

3. The booklet-making system of claim 1 wherein said raising means raises only one side of the signature or stack of signatures where said printing means can direct ink jets in a direction having a vertical component upon the raised portion thereof, and said signature backing and aligning means includes means forming a backing for the still vertically extending other side of the raised signature or stack of signatures involved.

4. The booklet-making system of claim 3 wherein said signature backing and aligning means includes an edge-forming means having an edge which engages and forces the raised fold toward said backing means, the edge of said edge-forming means receiving thereover the fold of the signature or signatures involved than to align the same.

5. The booklet-making system of claim 4 where said edge-forming means is the longitudinal edge of a generally horizontal support table portion of a plate forming said raising means.

6. The booklet-making system of claim 3 wherein the trailing edge of the still vertically extending side of said signature or stack of signatures is engaged and pushed by said signature stack positioning means of said conveyor means while the signatures are raised from the top of said conveyor means.

7. The booklet-making system of claim 3 wherein there is provided ink jet printing means located on one side of said conveyor means to direct jets of ink upon the raised upper surface of the signature to be printed upon in a direction having a vertical component.

8. The booklet-making system of claim 2 wherein said signature backing and aligning means include air jet means for directing jets of air against the crotch of the fold of the raised signature or stack of signatures involved to push the fold edge thereof into the crotch of said signature backing and aligning means.

9. The booklet-making system of claim 3 wherein said signature raising means is a gull-wing plate having a progressively rising leading edge portion ahead of said printing station for progressively raising said one side of the signature or stack of signatures to be printed upon.

10. The booklet-making system of claim 3 wherein said signature raising means includes a horizontal support plate opposite said printing station and which forms a support table for the panel of the signature or stack of signatures to be printed upon, and said signature backing and aligning means includes an angle member having a horizontal leg spaced a small distance above the longitudinal edge of said support plate so that the side of the signature or stack of signatures to be printed upon is loosely and slidable confined therebetween.

11. The booklet-making system of claim 10 wherein said vertical leg of said angle member is said means for backing the still vertically extending side of said signatures or stack of signatures.

12. The booklet-making system of claim 11 wherein there is provided means for horizontally adjusting said plate toward and away from said vertical leg of said angle member.

13. The booklet-making system of claim 11 or 12 wherein there is provided means for adjusting the elevation of said plate to vary the spacing between said plate and the horizontal leg of said angle member forming said backing and aligning means.

14. The booklet-making system of claim 13 wherein there is also means for varying the elevation and horizontal position of said angle member.

15. The booklet-making system of claim 10 wherein there is associated with said angle member means for sensing an upward force applied thereto as a result of the jamming of a signature between said horizontal leg thereof and said plate, and means responsive to said upward force for terminating the movement of said conveyor means.

16. The booklet making system of claim 1 wherein said conveyor means is a collating conveyor chain.

* * * * *